United States Patent [19]

Wright

[11] 4,251,357

[45] Feb. 17, 1981

[54] SLUICE CONSTRUCTION

[76] Inventor: Winston F. Wright, 2060 Fair Cir., Reno, Nev. 89503

[21] Appl. No.: 57,751

[22] Filed: Jul. 16, 1979

[51] Int. Cl.[3] ..... B03B 5/12

[52] U.S. Cl. ..... 209/437; 209/485; 209/487

[58] Field of Search ..... 209/251, 26 C, 435–437, 209/440–444, 458, 460, 485–487, 490, 504, 506, 508

[56] References Cited

U.S. PATENT DOCUMENTS

| | | | |
|---|---|---|---|
| 73,306 | 1/1868 | Donnelly | 209/437 |
| 999,456 | 8/1911 | Jones | 209/485 X |
| 1,105,977 | 8/1914 | Johnson | 209/446 |
| 3,143,495 | 8/1964 | Stephan | 209/504 X |
| 3,667,601 | 6/1972 | Johnston et al. | 209/486 X |
| 4,078,996 | 3/1978 | Cohen-Alloro et al. | 209/504 X |

*Primary Examiner*—William A. Cuchlinski, Jr.
*Attorney, Agent, or Firm*—Charles E. Temko

[57] ABSTRACT

A continuous run sluice box having vibrating and sonic vibration means for concentrating gold or other precious metal, while eliminating the loss of black sands normally accompanying the use of conventional sluices. The sluice box is provided with a sonic vibrating means, and it is mounted for rotation about its own peripheral axis. The sluice includes two parallel channels disposed on either side of a main floor, so that the uppermost channel may be in use, while the lowermost channel is cleaned by directing streams of water and sonic vibration against the clogged riffles, thereby eliminating down time normally involved in periodic cleaning.

3 Claims, 3 Drawing Figures

SLUICE CONSTRUCTION

BACKGROUND OF THE INVENTION

This invention relates generally to the field of placer mining, and more particularly to an improved form of continuous run sluice box adapted for operation with little if any down time for cleaning.

In the traditional placer mining process, large amounts of ore and sands are continuously washed in a sluice which is not subjected to constant vibration. The heavier precious metal and accompanying black sands sink to the bottom of the sluice, and the lighter weight sands and other impurities are washed away. Large scale placer mining is relatively inefficient, in that the black sands which accompany the precious metal often, with further refining, will realize other products which are worth as much or more as the recovered precious metal. In the traditional sluice, the riffles or transversely extending walls disposed at periodic intervals, periodically become filled and packaged with recovered material, and operation must be then halted so that the material can be removed, usually as a hand operation. During this period, no washing of ore can take place.

SUMMARY OF THE INVENTION

Briefly stated, the invention contemplates the provision of an improved continuous run sluice box in which the above mentioned disadvantages of conventional sluice boxes have been substantially eliminated. The device includes an elongated frame member having a generally H-shaped cross-section forming a pair of oppositely disposed channels on either side of a centrally disposed floor. Each of the channels is provided with riffles, or short walls, extending transversely of the principal axis of the channels. The frame is mounted for rotation about its own longitudinal axis, so that either one or the other of the channels may be positioned to face upwardly, for normal operation, while the other of the channels is disposed therebeneath facing downwardly so that a stream or streams of water may be directed thereagainst to clear the spaces between the riffles, and allow the collected material to drop into a holding tank which may be removed when filled and the contents transferred for further processing. The elongated frame is carried by a base member supporting a pivotally mounted support element which adjusts the angle of inclination of the frame, and provides means for supporting the same for the above-mentioned axial rotation. The support element also carries as self-powered sonic vibrating means which can be selectively connected to the frame in either of two positions during operation.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
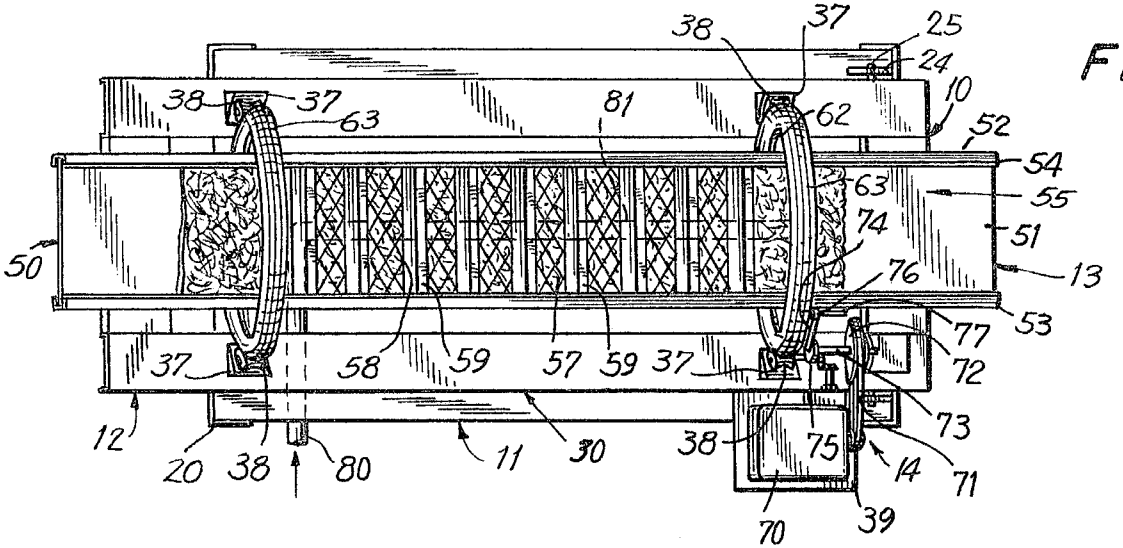
FIG. 1 is a top plan view thereof.

In accordance with the invention, the device, generally indicated by reference character 10, comprises broadly: a base element 11, a pivotally mounted support element 12, an axially rotatable sluice element 13, selectively connectable vibrating means 14, and a spray element 15.

The base element 11 is preferably of welded steel construction, and includes a plurality of vertical legs 20, supporting a rectangular horizontal frame 21. The frame 21 includes a pair of side members 22 joined by a pair of end members 23. One of the end members 23 includes a pair of upstanding trunnion brackets 24 engaged by pintles 25. The other end member 23 supports an elevating means 26 of desired type. If desired, the legs 20 may be stiffened by angularly disposed braces 27 welded thereto.

The support element 12 is carried by the base element 11, and includes a rectangular frame 30 comprising side members 31 and end members 32. Downwardly extending brackets at one end are carried by the pintles 25, whereby the elevating means 26 may adjust the angle of incline of the sleeve element 13. Four bearing members 37 are located near the corners of the frame 30 and are provided with grooved rollers 38. An auxiliary platform 39 having an outrigger brace 40 supports the vibrating means 14.

The sluice element 13 extends substantially the length of the base element 11, and is of generally H-shaped cross-section. It includes a principal frame 50 having a floor member 51 joining a pair of side walls 52 and 53, each having converging lips 54 at the free edges thereof to form first and second channels 55 and 56. Overlying the surfaces of the floor member 51 are filter members 57 of fiberglass or the like, held in position by a perforated wall 58 which mounts a plurality of transversely extending riffles 59.

Mounted on the outer surfaces of the side walls 52–53 are laterally extending flanges 60, at least those at one end of the frame 50 being provided with openings 61. The flanges 60 carry circular rims 62 mounting pneumatic tires 63 which engage the grooved rollers 38 of the bearing members 37. If desired, an upstanding flange 64 may be provided to prevent accidental dislodgement of the frame 50.

The sonic vibrating means 14 may be of any desired type, and preferably includes a small internal combustion motor 70, or electrically powered equivalent, driving the belt 71 entrained on a pulley 72 carried by a shaft 73. An elongated link 74 is eccentrically mounted at one end 75 with respect to the shaft 73, the opposite end 76 being provided with a lateral extension 77 selectively engageable in one of the openings 61 for the transmission of vibration from the means 14 to the element 13.

The spray element 15 includes a laterally extending conduit 80 connected to a convenient source of water (not shown) and a longitudinally arranged conduit 81 carrying a plurality of upwardly facing spray heads 82, the conduit 81 being disposed substantially parallel to the axis of the sluice element 13.

Figure 2:
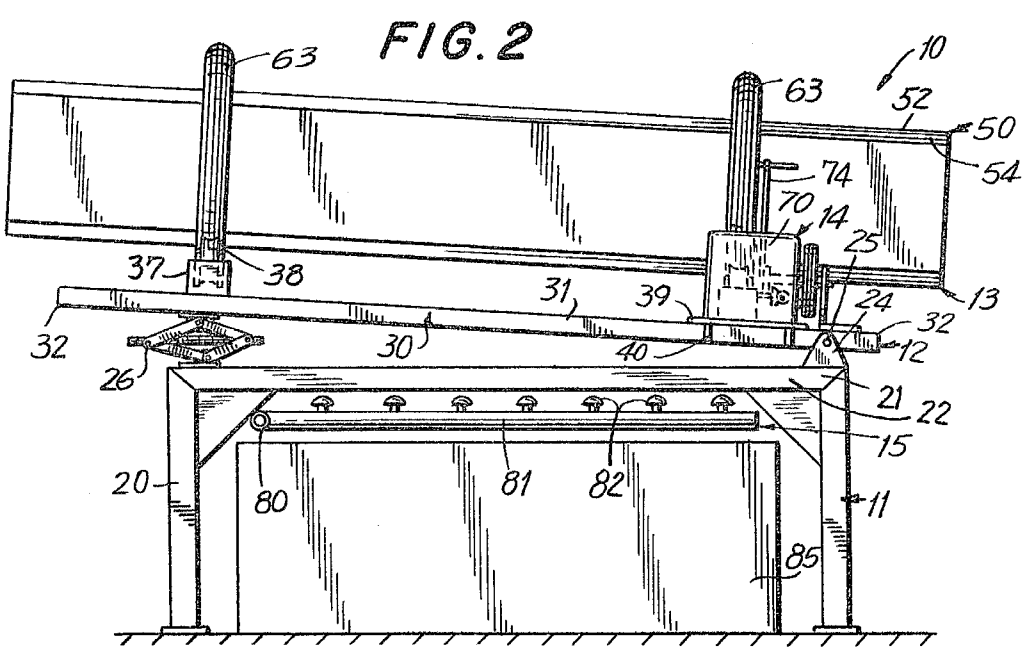
FIG. 2 is a front elevational view of an embodiment of the invention.
Figure 3:
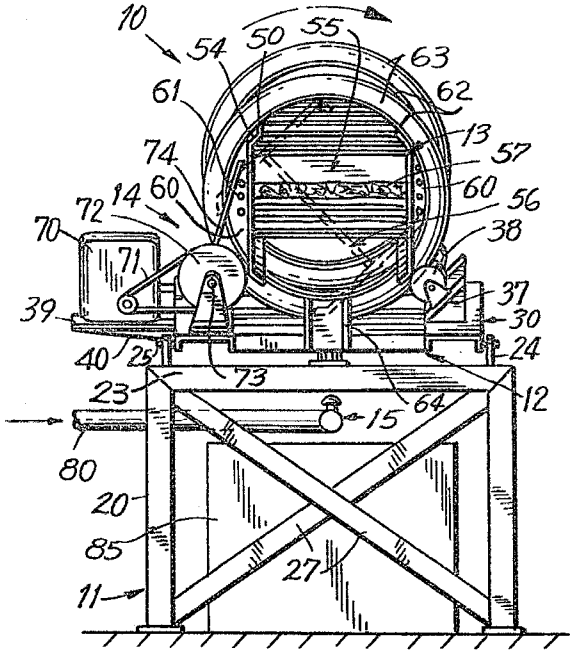
FIG. 3 is a side elevational view thereof, showing certain of the component part in altered relative position.

During operation, the element 13 is rotated through a position shown in FIG. 2, wherein one of the channels 55 faces upwardly to receive ore and a source of continuously flowing water (not shown), whereby the ore is sluiced in normal manner. With passage of time, the riffles 59 will collect the precious metal, as well as the heavier black sands. The sonic vibration will prevent the riffles from packing. The same vibration will clean the gold fines and coated black sand precious products at the same time. When the riffles become filled, the link 74 is disconnected, and the element 13 manually or otherwise rotates through substantially 180° wherein the channel 55 faces downwardly, and a relatively clean previously downwardly facing channel 56 is exposed so that the sluicing operation can be continued with the reconnecting of the link 74.

If desired, the vibrator structure can be constructed at the upper portion of the sluice box, so that the sluice box can be rotated without disconnecting any pins or other interconnecting structure. If desired, the vibrator may be of a type which induces supersonic vibration, as well as, or in lieu of sonic vibration, with a corresponding increase in efficiency.

When the channel 55 has reached its downward condition, the spray element 15 is operated whereby the spray of water will loosen the materials connected between the riffles (already partially loosened by the vibration) to drop into a holding tank 85 or other receptacle for collection. The receptacle 85 may be removed at periodic intervals as it becomes filled, so that the contents may be further refined.

It will be apparent that the rotation of the element 13 as above described requires only a moment's time, and the clogged channel 55 or 56 may be cleared while the sluicing operation continues with the upwardly exposed channel. Thus, there is very little down time, and with proper operation, a relatively short element 13, approximately six to eight fee long, can easily process between 400 and 500 tons of ore per day.

When moving the device into a new location, the element 13 may be manually separated from the remaining parts of the device, permitting a relatively small sized version to be easily handled by only two men and carried on a small pick-up truck.

I wish it to be understood that I do not consider the invention limited to the precise details of structure shown and set forth in this specification, or obvious modifications will occur to those skilled in the art to which the invention pertains.

I claim:

1. Improved sluice construction for placer type mining, comprising: an elongated frame of generally H-shaped cross-section, including a floor member and first and second side walls interconnected by said floor member, to form first and second parallel channels; a first set of riffles extending laterally between said side walls in said first channel, and a second set of riffles extending between said side walls in said second channel; means supporting said elongated frame for selective intermittent rotation about its own axis to expose one of said channels in an upwardly facing orientation; and means for directing a stream of liquid against the riffles in the downwardly facing other of said channels whereby one of said channels may be flushed while the other is in use.

2. Sluice construction in accordance with claim 1, further characterized in the provision of a base element for supporting said device upon a horizontal surface, a pivotally mounted support element carried by said base element, bearing means mounted upon said support element, said elongated frame having circular rims engaging said bearings for relative movement.

3. Sluice construction in accordance with claim 2, further characterized in the provision of powered sonic and supersonic vibrating means carried by said support element, and means linking said vibrating means with said elongated frame element.

* * * * *